US006019243A

United States Patent [19]

Marino

[11] Patent Number: 6,019,243

[45] Date of Patent: Feb. 1, 2000

[54] SPILL CONTAINMENT RECEPTACLE FOR USE WITH TANK TRANSPORTS

[76] Inventor: Thomas F. Marino, 26 Hydelor Ave., Prospect, Conn. 06712

[21] Appl. No.: 08/118,925

[22] Filed: Sep. 9, 1993

[51] Int. Cl.[7] ..... B65D 1/34

[52] U.S. Cl. ..... 220/573

[58] Field of Search ..... 220/571, 571.1, 220/573

[56] References Cited

U.S. PATENT DOCUMENTS

| | | | |
|---|---|---|---|
| 446,518 | 2/1891 | Hesser . | |
| 2,754,869 | 7/1956 | Bartels . | |
| 2,778,398 | 1/1957 | Edwards | 220/571.1 |
| 3,651,884 | 3/1972 | Dorries | 220/573 |
| 3,727,656 | 4/1973 | Luders . | |
| 4,020,922 | 5/1977 | Klasel . | |
| 4,201,307 | 5/1980 | Malloy | 220/573 |
| 4,211,266 | 7/1980 | Massey . | |
| 4,240,474 | 12/1980 | Perkins . | |
| 4,307,764 | 12/1981 | Nattrass . | |
| 4,550,755 | 11/1985 | Vredenburg . | |
| 4,676,284 | 6/1987 | DeCrane . | |
| 4,682,672 | 7/1987 | Berger et al. | 220/573 |
| 4,775,067 | 10/1988 | Mount | 220/573 |
| 4,991,633 | 2/1991 | Wong . | |
| 5,090,588 | 2/1992 | Van Romer et al. | 220/573 |
| 5,099,872 | 3/1992 | Tarvin et al. | 220/573 |
| 5,316,175 | 5/1994 | Van Romer | 220/573 |

OTHER PUBLICATIONS

New Pig Corporation Catalog, Nov. 1992 Issue, Product Data Sheet.

*Primary Examiner*—Joseph M. Moy
*Attorney, Agent, or Firm*—Pepe & Hazard LLP

[57] ABSTRACT

A spill containment receptacle for use with a tank has a flexible receptacle member defining an enclosure. It has a bottom wall and a sidewall extending upwardly and inwardly from the periphery of the bottom wall to a height that is less than the width of the bottom wall. The upper end portion of the sidewall has a collar extending thereabout and defining on opening adjacent the upper end of the receptacle member which is of lesser area than the bottom wall. Straps are attached to the collar for securing the receptacle member to an associated tank. The opening of the receptacle member is positioned directly beneath a point of leakage from the tank, and the upper end of the sidewall is positioned adjacent the surface of the tank about the point of leakage.

14 Claims, 3 Drawing Sheets

10
12
14
16
17
18
20
24
26
28
30
32
34
36
37
38
40
41
42
43
44
46
48
50
52
3
4

SPILL CONTAINMENT RECEPTACLE FOR USE WITH TANK TRANSPORTS

BACKGROUND OF THE INVENTION

The present invention relates generally to vessels for containing spills of liquid or solid material, and, more particularly, to a collapsible spill containment receptacle for use with storage and transport tanks.

The transportation of hazardous and non-hazardous liquid and solid chemical and petroleum products is a thriving industry in this and other countries, with large quantities of such products being transported annually. Tanker trucks and railroad tanker cars having storage tanks are normally utilized to effect the transport of these materials and sometimes develop leaks in their valves or walls of the tanks, thereby permitting the contents to spill into the outside environment. Such leaks are not infrequent and can occur from undetected damage, aging of the equipment, or continual vibration.

Moreover, even stationary storage tanks may develop leans as a result of corrosion, impacts, and failure of materials.

The resulting spills not only result in the commercial loss of product, but they also often jeopardize the environment or even pose a direct and immediate hazard to human health and safety in the case of hazardous substances. Accordingly, some statutes have been enacted which impose fines upon the operators of tank transports if a spill occurs. The operators are generally required to absorb the cost of the cleanup of the spill.

Many containment and diverter structures have been proposed to deal with the problem of these spills. Some prior art containment vessels rely upon straps to hold the vessel in position beneath or around the leaking equipment, and to hold the vessel in an open, spill receiving position. Reliance upon the straps alone, with a collapsible container, leads to instability. This can result in a secondary spill from the container if it is not properly handled, if the containment system fails, or if, through inadvertence, the container is dislodged from the leaking equipment.

It is an object of the present invention to provide a novel, stable but flexible spill containment receptacle for use with tanks.

It is also an object to provide such a containment receptacle which is collapsible for transport on a tank transport, thereby enabling immediate response to the development of a leak.

A further object is to provide such a containment receptacle which can be readily and relatively economically fabricated.

SUMMARY OF THE INVENTION

It has now been found that the foregoing and related objects may be readily attained in a spill containment receptacle for use with a tank transport. The spill containment receptacle has a flexible receptacle member defining an enclosure and having a bottom wall and a sidewall extending upwardly and inwardly from the periphery of the bottom wall to a height that is less than the width of the bottom wall. The upper end portion of the sidewall has a collar extending thereabout and defining on opening adjacent the upper end of the receptacle member which is of lesser area than the bottom wall. Straps are attached to the collar for securing the receptacle member to an associated tank. The opening of the receptacle member is positioned directly beneath a point of leakage from the transport, and the upper end of the sidewall is positioned adjacent the surface of the tank about the point of leakage.

Preferably, the flexible receptacle member has a rectangular cross section, the bottom wall is rectangular in shape, and the sidewall has opposed end panels and opposed side panels which are generally trapezoidal in shape. The receptacle member includes additional strips of material overlying the junction of adjacent sidewall panels, and additional strips of material overlying the side panels intermediate their length and parallel to the strips overlying the junctions. A portion of each strip intermediate the length of the strip is doubled upon itself to form a tie down strap portion.

In its most desirable embodiment, the collar of the receptacle member is buoyant. The receptacle member has an additional layer of material overlying the collar to provide reinforcement, and a buoyant substance, typically in the form of strips of buoyant material, is interposed between the collar and the additional layer of material to provide buoyancy to the upper end portion of the sidewall. The collar may extend upwardly and outwardly from the lower margin thereof.

The securing means includes at least one pair of eyelets in each of a pair of opposing panels, and further includes straps for engaging in the eyelets. The receptacle may be used for a liquid material or a solid bulk material.

In the method for containing a spill from a tank, the securing means of the spill containment receptacle is engaged with a portion of a tank having a leak. The opening in the receptacle is disposed below and adjacent the point of the leak whereby the spill flows through the opening and into the enclosure.

Preferably, when the collar is buoyant, liquid material from the leak is allowed to collect and cause the collar to float upon the upper surface of the liquid material as the upper surface rises within the enclosure.

DETAILED DESCRIPTION OF THE PREFERRED EMBODIMENT

Figures 1, 2:
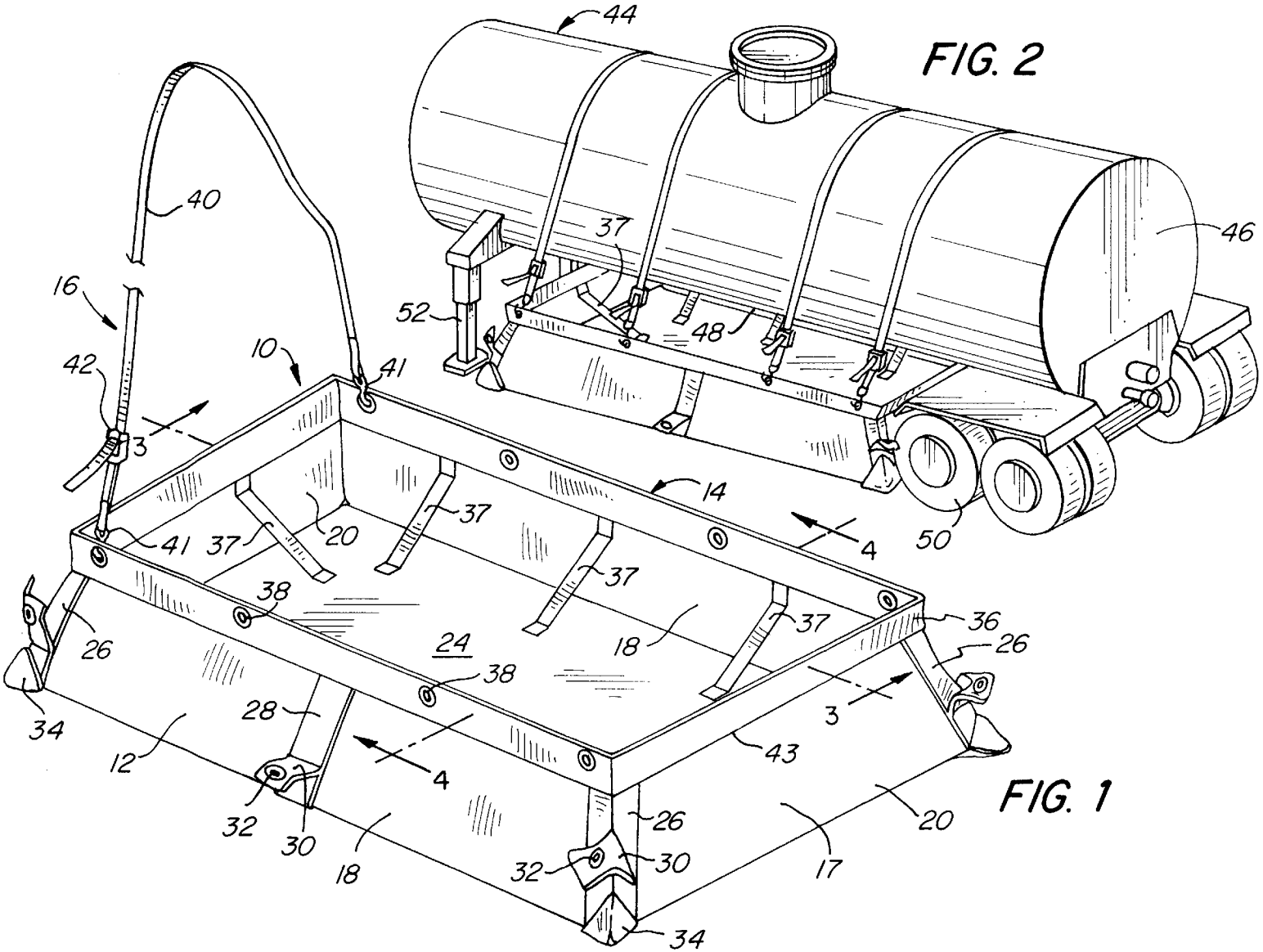
FIG. 1 is a perspective view of a spill containment receptacle embodying the present invention and shown in condition with only one fragmentarily illustrated strap.
FIG. 2 is a perspective view of the spill containment receptacle shown positioned in a spill receiving position under the tank and strapped to the tank.

Turning first in detail to FIG. 1, therein illustrated is a spill containment receptacle embodying the present invention and generally designated by the numeral 10. The containment receptacle 10 includes a flexible receptacle member generally designated by the numeral 12, and having an opening 14 at its upper end, and a securing strap generally designated by the numeral 16.

The receptacle member 12 includes a sidewall 17 comprised of side panels 18, and end panels 20, all of trapezoidal configuration. The sidewall 17 extends upwardly and inwardly from the periphery of the rectangular bottom wall 24, and its height is less than the width of the bottom wall 24 to provide stability.

The upper end of the sidewall 17 has a collar portion 43 extending about its periphery, and the cross section or area of the opening defined thereby is less than the area of the bottom wall 24.

An edge reinforcement strip 26 is provided to overlie each of the four essentially vertical edges formed at the junction of adjacent panels 18 and 20. The edge reinforcement strip 26 may comprise the same sheet material as that used for the panels 18 and 20, or a rugged woven fabric exhibiting the desired chemical resistance which may also be provided by a coating on the fabric. The edge reinforcement strips 26 are secured to the edge portions of the panels 18 and 20 by sealing and/or sewing as described below, and desirably continue onto the surface of the bottom wall 24. An intermediate reinforcement strip 28 is provided on each of the side panels 18 intermediate their length, and it extends along the bottom wall 24 for additional strength. The intermediate reinforcement strips 28 are generally comprised of the same material, and secured in the same manner as the edge reinforcement strips 26.

Figure 3:
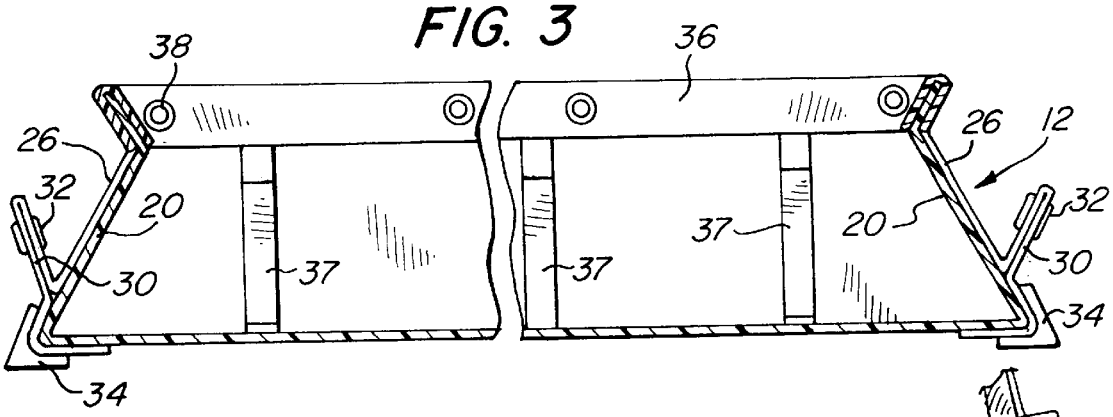
FIG. 3 is a fragmentary vertical cross-sectional view of the spill containment receptacle of FIG. 1, taken along the line 3—3 with the strap removed.

As is best seen in FIG. 3, a portion of each intermediate reinforcement strip 28 and each edge reinforcement strip 26 is doubled upon itself to form a tie down strap portion 30 having an eyelet 32. A corner support 34 is secured to each of the four corners of the rectangular bottom wall 24 to provide further support for the flexible receptacle member 12.

Figure 4:
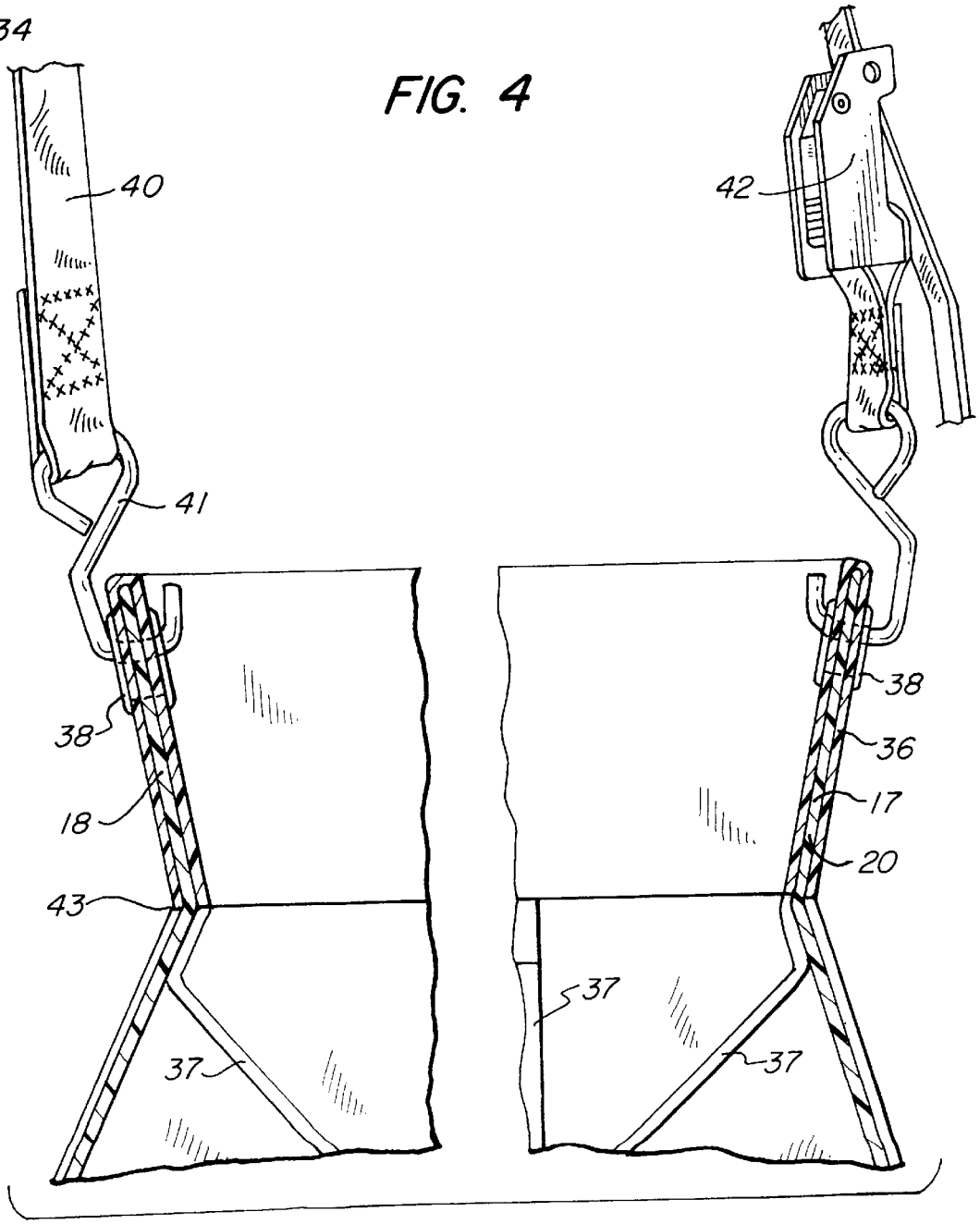
FIG. 4 is a fragmentary vertical cross-sectional view of the spill containment receptacle of FIG. 1, taken along the line 4—4.

As is best seen in FIG. 4, a reinforcing strip 36 is secured in the same manner as strips 26 and 28 to the outer surface of the closed sidewall 17 adjacent its upper edge, folded inwardly over the upper edge, and secured to the inner surface of the closed sidewall 17 adjacent its upper edge. The strip 36 may comprise an additional layer of the same sheet material as that used for the panels 18 and 20, or a rugged woven fabric exhibiting the desired chemical resistance.

Figure 5:
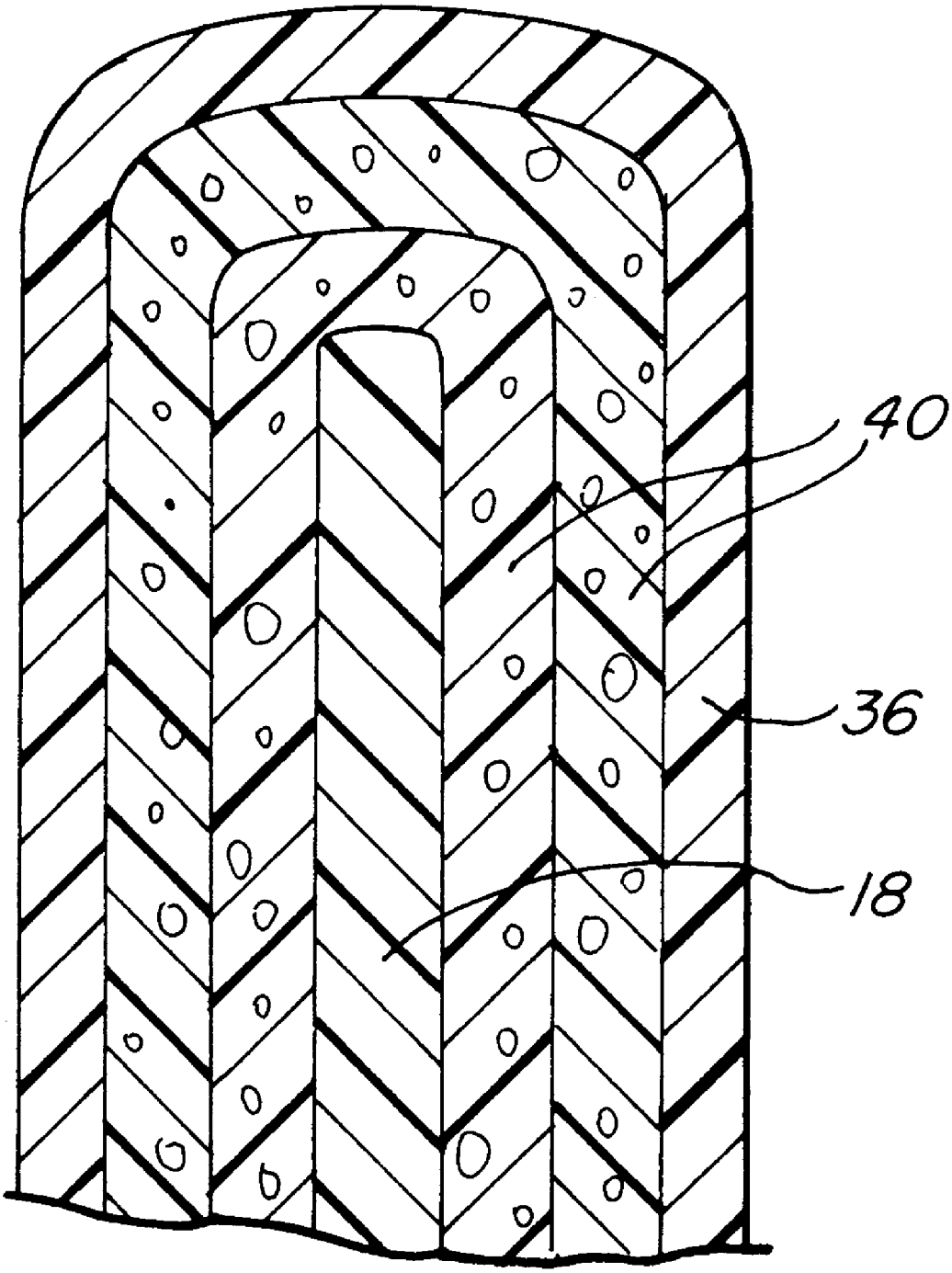
FIG. 5 is a fragmentary view, in enlarged scale, of the upper portion of one of the side panels of FIG. 4, showing a reinforcing strip overlying strips of buoyant material.

As seen in FIG. 5, the strip 36 may overlie a strip or strips 40 of a buoyant material such as a closed form of polyurethane or polyvinyl chloride. Use of such buoyant material ensures that the upper edge of the side wall 17 and the receptacle opening 14 will remain above the upper surface of any liquid material that is leaking into the containment receptacle 10. This is especially important if such leakage should occur prior to full installation of the containment receptacle 10, since the floating of the buoyant material as the level of spilled liquid rises, assists in extending the receptacle 10 and allows the receptacle to retain a quantity of spill even if not suspended.

As an alternative to using strips of buoyant material 40, the reinforcing strip 36 may overlie or provide a chamber channel which may be filled with a gas from a suitable source. The gas filled chamber will therefore provide the necessary buoyancy.

Optionally, reinforcement strips 26 and 28 may also overlie gas tight chambers to provide additional buoyancy and rigidity. An additional reinforcement strip, overlying a further gas tight chamber may also be provided to the lower portion of sidewall 17 for additional support.

For additional support, the sidewall 17 may be provided with one or more anchor straps 37, spaced about the periphery. The anchor straps 37 are fastened at one end to the inner surface of the sidewall panels 18 and 20 at a point adjacent and below the reinforcing strip 36. The straps 37 extend downwardly and inwardly from the panels 18 and 20 in a plane normal to the panels 18 and 20 and are attached to the inner surface of the bottom wall 24 at a point spaced inwardly from the sidewall 17. The anchor straps 37 may be fabricated from the same material as that used for panels 18 and 20 or from other chemical resistant material.

Four pairs of opposing strap eyelets 38 are provided in the collar portion 43 along the length of the side panels 18. Greater or fewer pairs of the eyelets 38 may be employed as appropriate to the dimensions of the flexible receptacle member 12. A strap 16 is provided for each pair of opposing strap eyelets 38, and these include hooks 41 at each end thereof to engage in the strap eyelets 38, and a length adjustment buckle 42 to adapt the strap 16 to different installation situations. Preferably, the straps 16 are made from a high strength nylon web material, and the strap hooks 41 are made from stainless steel.

Optionally, the sidewall 17 may be fabricated to extend upwardly and inwardly only to the lower portion of the collar 43, which portion is of reduced cross-section, intermediate the height of the sidewall 17 and positioned below the reinforcing strip 36. Above the lower portion of the collar 43, the collar 43 and the sidewall 17 may extend upwardly and outwardly to provide a funnel-like upper end portion.

Turning now to FIG. 2, the use of the spill containment receptacle 10 will now become apparent to one skilled in the art. There is shown a tank transport trailer, generally designated by the numeral 44 and having a tank 46 with an underside 48. The tank transport trailer 44 has wheels 50 and landing gear 52. The tank 46 sits on a chassis (not shown) with rails (not shown) extending from the front to the rear of the chassis. The spill containment receptacle 10 is suspended from the tank transport trailer 44 between the wheels 50 and the landing gear 52 by draping the straps 16 over the tank 46 and inserting the strap hooks 41 through the eyelets 38 in the reinforcing strip 36 of the receptacle 10. It should be noted that the receptacle 10 is in an extended position with the receptacle opening 14 directly beneath the underside 48 of the tank 46. Any liquid leaking from the tank 46 will be collected or contained within the receptacle 10 and will not fall onto the pavement or surrounding area. As the receptacle 10 fills, the sidewall 17 is moved upwardly because of the inwardly tapering configuration. This action is enhanced by the use of the buoyant material in the collar for liquid spills.

After the leak is stopped, the liquid collected in the containment receptacle 10 can be pumped into an emergency tanker truck (not shown) or back into the tank 46. Thereafter, the receptacle 10 can be decontaminated for reuse and collapsed and folded into a small package.

The receptacle is fabricated from sheet material with sealed seams to provide a leak-proof container, with the sealing being effected by means of separate adhesives, or by heat or solvent depending upon the material. Optionally, the seams of the receptacle may be both sealed, as described, and sewn. If the receptacle is to contain solid spills only, then the seams may simply be sewn. The sheet material is foldable and durable. Suitable materials include synthetic rubber (e.g., butadiene/acrylonitrile copolymer, polychloroprene, polyisoprene), polyurethanes, polypropylene and polyvinyl chloride providing the desired chemical inertness and capability of withstanding concentrated acids, alkalis, solvents, petrochemicals and other chemical compounds of either hazardous or non-hazardous nature. The resin sheeting may be reinforced internally or externally with glass, resin, carbon, cotton, nylon and other fibers to increase strength; and, in the preferred embodiment, comprises a laminate of a woven nylon material core with outer resin layers of polyurethane or rubber, providing a fluid impermeable structure that is lighter than what currently exists in the prior art.

In the preferred embodiment, the receptacle member 12 is fabricated from two pieces. The first piece provides the bottom wall 24 and any two opposing sidewall panels, 18, 20. The other piece provides another bottom wall 24 and the other two opposing panels 18, 20. In this manner, the receptacle member 12 is provided with a double layered bottom wall 24 for extra strength. Optionally, the flexible receptacle member may be constructed from a single continuous blank that provides the bottom wall 24, the side panels 18, and the end panels 20. In the alternative, the receptacle member 12 may be constructed from three pieces, with the first piece providing the bottom wall 24 and any two opposing sidewall panels 18, 20, and the other pieces providing the other two sidewall panels 18, 20. All seams between the bottom wall 24, and the panels 18, 20, and between the panels 18, 20 themselves, are sealed as described above.

The receptacle of the present invention may be carried in a folded condition within a compartment of a vehicle so as to be readily accessible in an emergency situation to contain a spill of any liquid or solid carried in the tank. The receptacles may be carried in the vehicles of state, local and federal authorities or stored in strategic locations such as toll booths, state garages and weighing stations to enable rapid response to emergency spills and minimize the environmental impact. The receptacle may also be used to contain spills from railroad tanker cars and the like, or from tank transport trailers or railroad tanker cars that have tipped over onto their sides or tops. In storage areas with stationary tanks, such as industrial plants, tank farms, and the like, the containment receptacles may be stored in suitable compartments in the vicinity.

It should be apparent to those skilled in the art that the containment receptacle 10 can be formed in a variety of sizes and shapes. The cross section may be other than rectangular if so desired.

The receptacles may be colored coded or otherwise labelled to indicate the types of liquid material which may safely be contained. Additionally, each receptacle may be labelled with an expiration date indicating the date on which the receptacle must be replaced because age and exposure to fumes of materials being transported may be deleterious to the fabric. Finally, gloves and other personnel protective equipment may be provided with the receptacle as an emergency kit.

Thus, it can be seen from the foregoing specification and attached drawings that the spill containment receptacle provides an effective, stable and collapsible means for containing a leak of hazardous or non-hazardous materials from a tank. The receptacle is readily and quickly usable to minimize any environmental impact and may be readily and relatively economically fabricated.

Having thus described the invention, what is claimed is:

1. A foldable spill containment receptacle for use with a tank, comprising:

(a) a flexible and foldable receptacle member defining an enclosure of a length large enough to extend across an associated tank beneath which it is placed and having a bottom wall and a sidewall extending upwardly and inwardly from the periphery of said bottom wall to a height that is less than the width of said bottom wall, the upper end portion of said sidewall having a collar extending thereabout and defining a large opening adjacent the upper end of said receptacle member which is of lesser area than said bottom wall; and (b) foldable means attached to said collar for securing said receptacle member to the associated tank so as to position said opening thereof directly beneath a point of leakage from the tank and the upper end of said sidewall adjacent the surface of the tank about the point of leakage.

2. The spill containment receptacle in accordance with claim 1 wherein said flexible receptacle member has a rectangular cross section, said bottom wall is rectangular in shape, and said sidewall has opposed end panels and opposed side panels which are generally trapezoidal in shape.

3. The spill containment receptacle in accordance with claim 2 wherein said receptacle member includes additional strips of material overlying the junction of adjacent sidewall panels, and additional strips of material overlying said side panels intermediate their length and parallel to said strips overlying said junctions.

4. The spill containment receptacle in accordance with claim 3 wherein a portion of each strip intermediate the length of said strip is doubled upon itself to form a tie down strap portion.

5. The spill containment receptacle in accordance with claim 2 wherein said receptacle member has an additional layer of material overlying said collar to provide reinforcement.

6. The spill containment receptacle in accordance with claim 5 wherein a buoyant substance is interposed between said collar and said additional layer of material to provide buoyancy to said upper end portion of said sidewall.

7. The spill containment receptacle in accordance with claim 6 wherein said buoyant substance is a strip of buoyant material.

8. The spill containment receptacle in accordance with claim 7 wherein said collar extends upwardly and outwardly from the lower margin thereof.

9. The spill containment receptacle in accordance with claim 2 wherein said securing means includes at least one pair of eyelets in a pair of opposing panels, and further includes straps for engagment in said eyelets.

10. The spill containment receptacle in accordance with claim 1 wherein said enclosure is for a liquid material.

11. The spill containment receptacle in accordance with claim 1 wherein said collar extends upwardly and outwardly from the lower margin thereof.

12. The spill containment receptacle in accordance with claim 1 wherein said collar is buoyant.

13. In a method for containing a spill from a tank, the steps comprising:

(a) providing a flexible and foldable spill containment receptacle defining an enclosure of a length large enough to extend across a tank beneath which it is placed and having a bottom wall and a sidewall extending upwardly and inwardly from the periphery of said bottom wall to a height that is less than the width of said bottom wall, the upper end portion of said sidewall having a collar extending thereabout and defining a large opening adjacent the upper end of said receptacle member which is of lesser area than said bottom wall, said receptacle having foldable securing means attached to said collar; and (b) placing said receptacle below and adjacent the point of the leak of a tank and engaging said securing means of said spill containment receptacle with a portion of said tank having a leak, said opening in said receptacle being disposed below and adjacent the point of the leak whereby the spill flows through said opening and into said enclosure.

14. The method for containing a spill from a tank in accordance with claim 13 wherein said providing step includes providing a receptacle in which said collar is buoyant, and wherein said engaging step includes allowing liquid material from said leak to collect and cause the collar to float upon the upper surface of said liquid material as said upper surface rises within said enclosure.

* * * * *